US005915300A

United States Patent [19]

Greive et al.

[11] Patent Number: 5,915,300

[45] Date of Patent: Jun. 29, 1999

[54] PRINTING MACHINE WITH A SHEET-TRANSPORT BELT

[75] Inventors: Martin Greive; Christian Compera, both of Schoenau; Bernd Herrmann, Malsch, all of Germany

[73] Assignee: Heidelberger Druckmaschinen Aktiengesellschaft, Heidelberg, Germany

[21] Appl. No.: 08/874,258

[22] Filed: Jun. 13, 1997

[30] Foreign Application Priority Data

Jun. 13, 1996 [DE] Germany ..... 196 23 563

[51] Int. Cl.[6] ..... B41F 5/16

[52] U.S. Cl. ..... 101/181; 101/184; 101/479

[58] Field of Search ..... 101/181, 183, 101/182, 212, 218, 479, 120

[56] References Cited

U.S. PATENT DOCUMENTS

| | | | |
|---|---|---|---|
| 3,664,261 | 5/1972 | Dahlgren | 101/184 |
| 3,785,287 | 1/1974 | Dahlgren | 101/184 |
| 4,081,723 | 3/1978 | Vetter et al. | 101/181 |
| 4,183,296 | 1/1980 | Rambausek | 101/181 |
| 4,256,037 | 3/1981 | Vertegaaz | 101/181 |
| 4,517,221 | 5/1985 | Holl | 101/184 |
| 4,561,354 | 12/1985 | Glantschnig et al. | 101/181 |
| 4,625,639 | 12/1986 | Tsai | 101/181 |
| 5,423,255 | 6/1995 | Maass . | |
| 5,651,312 | 7/1997 | Borghesan | 101/181 |

FOREIGN PATENT DOCUMENTS

| | | |
|---|---|---|
| 587513 | 10/1933 | Germany . |
| 4243486 | 4/1994 | Germany . |

*Primary Examiner*—Eugene H. Eickholt
*Attorney, Agent, or Firm*—Kenyon & Kenyon

[57] ABSTRACT

A printing machine comprising a plurality of printing units (3) arranged in line one behind the other and an endless transport belt (4) for substrates to be printed, said transport belt running around, at least, two spaced-apart rollers (5, 6) and past said printing units. At least, two rollers (5, 6) are mounted on a coherent belt-carrying unit (9) from which, when being in a slack condition, said transport belt (4) may be stripped off. Furthermore, the printing machine features a drawer (24) which may be pulled out laterally and which is provided below said belt-carrying unit (9) as well as a holding device (11, 12, 13, 15, 16) holding said belt-carrying unit (9) and being switchable between, at least, two different conditions, in a first condition said holding device holding said belt-carrying unit in an operating position, and in a second condition said belt-carrying unit (9) resting loosely on said drawer (24). This permits a simple and quick belt changing.

11 Claims, 4 Drawing Sheets

PRINTING MACHINE WITH A SHEET-TRANSPORT BELT

FIELD OF THE INVENTION

The present invention relates to a printing machine comprising a plurality of printing units arranged in line one behind the other and an endless transport belt for substrates to be printed, said transport belt running around at least two spaced-apart rollers and past the printing units.

RELATED TECHNOLOGY

An arrangement comprising an endless sheet-transport belt and a plurality of ink-transfer devices is known from the German Patent Publication DE-PS 587 513 and from color copiers, for example.

When in operation, the transport belt is subjected to wear and tear and thus has to be replaced by a new transport belt from time to time, With color copiers such a replacement occurs relatively rarely, so that the installation operations related to replacement of the transport belt are relatively unimportant. However, the use of a transport belt in a printing machine designed for higher print runs may, in some cases, make it necessary to replace such a transport belt at much shorter intervals.

The German Publication 42 43 486 discloses a feed table of a printing machine comprising at least two rollers (8, 9) around which an endless transport belt (10) is guided and which are supported in a belt-carrying unit (7) permitting a belt changing by removing said belt-carrying unit (7) from the feed table.

SUMMARY OF THE INVENTION

It is an object of the present invention to reduce the standstill times caused by changing belts in a printing machine comprising an endless sheet-transport belt.

According to the present invention this object is achieved in a printing machine in that at least two rollers are mounted on a coherent belt-carrying unit from which, when being in a slack condition, the transport belt may be stripped off, in that the printing machine features a drawer which may be pulled out laterally and extends below the belt-carrying unit, and in that a holding device holding the belt-carrying unit is fastened to the printing machine, said holding device being switchable between at least two different conditions; in a first condition the belt-carrying unit being held by the holding device in an operating position, and in a second condition the belt-carrying unit resting loosely on the drawer.

The present invention permits a convenient and quick belt change, without requiring any tools. For this purpose, the holding device is switched over by the machine operator, the drawer and the belt-carrying unit are pulled out, the belt-carrying unit is removed from the drawer, and the transport belt is manually stripped off the belt-carrying unit. The drawer may be designed at a favorable price, as it is not in operation when the transport belt is running.

If the printing machine features a machine frame with firm side walls, the side wall on which the drawer may be pulled out is provided with an appropriate opening.

Devices for producing counter-pressure for the printing units, such as impression cylinders, may be integrated into the belt-carrying unit.

In a preferred embodiment, a tensioning roller being resiliently mounted on the drawer is used to keep the transport belt tight during operation. After having loosened the holding device, the tensioning roller automatically yields to the natural weight of the belt-carrying unit so that the belt-carrying unit may lower itself into the drawer.

In cases in which the natural weight of the belt-carrying unit does not suffice to lower it into the drawer, any device for relaxing the tensioning roller may be used, said device being simultaneously actuated with the holding device and being connected thereto, for example. Furthermore, it is possible to use a tensioning roller which is mounted on the machine frame and which is lifted off the transport belt when pulling out the drawer—synchronized with the actuation of the holding device, if necessary. It is also possible to use a tensioning roller provided inside the belt-carrying unit and acting towards the outside. In order to facilitate the stripping-off of the sheet-transport belt from the belt-carrying unit, the belt-carrying unit may be provided with a locking device for the tensioning roller, for example, In one embodiment, the holding device for the belt-carrying unit comprises a number of adjustable stops provided on the printing machine and at least two quick-action tensioning devices which are switchable between at least two different positions: in a first position said quick-action clamping devices press the belt-carrying unit against the stops, and in a second position the belt-carrying unit is released towards the drawer. By means of the stops the operating position of the sheet-transport belt is precisely defined and adjustable.

Preferably the quick-action tensioning devices are designed as roller levers controlled by toggle levers, with one roller rolling off on a respective cam surface formed on the belt-carrying unit during rotation of the roller lever. By appropriately designing the cam surface, stable intermediate positions of the belt-carrying unit may be realized with a view toward enabling the transport belt to run under reduced pressure of the printing units or without any pressure, for example. Due to an appropriate arrangement of the cam surface the belt-carrying unit, when being in a respective intermediate position, may be lowered only on one side, with one driven roller of the belt-carrying unit remaining where it is in order to come into meshing contact with a drive gearwheel provided on the printing machine or to drive other machine parts.

BRIEF DESCRIPTION OF THE DRAWINGS

Further features and advantages of the invention result from the following description of an embodiment and the following drawings.

DETAILED DESCRIPTION

Figure 1:
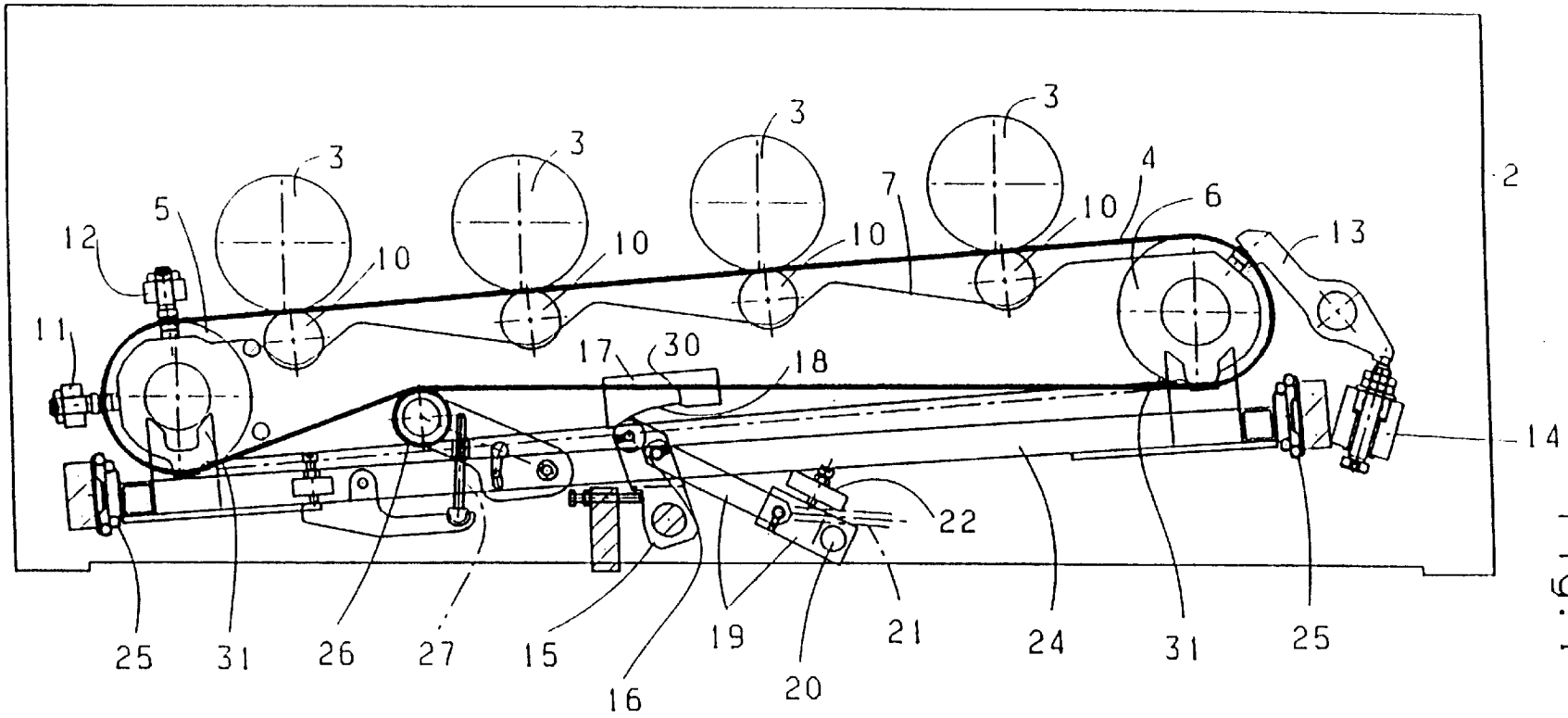
FIG. 1 is a sectional view of the printing machine—taken in longitudinal direction—comprising an endless sheet-transport belt located on a removable belt-carrying unit.
Figure 2:
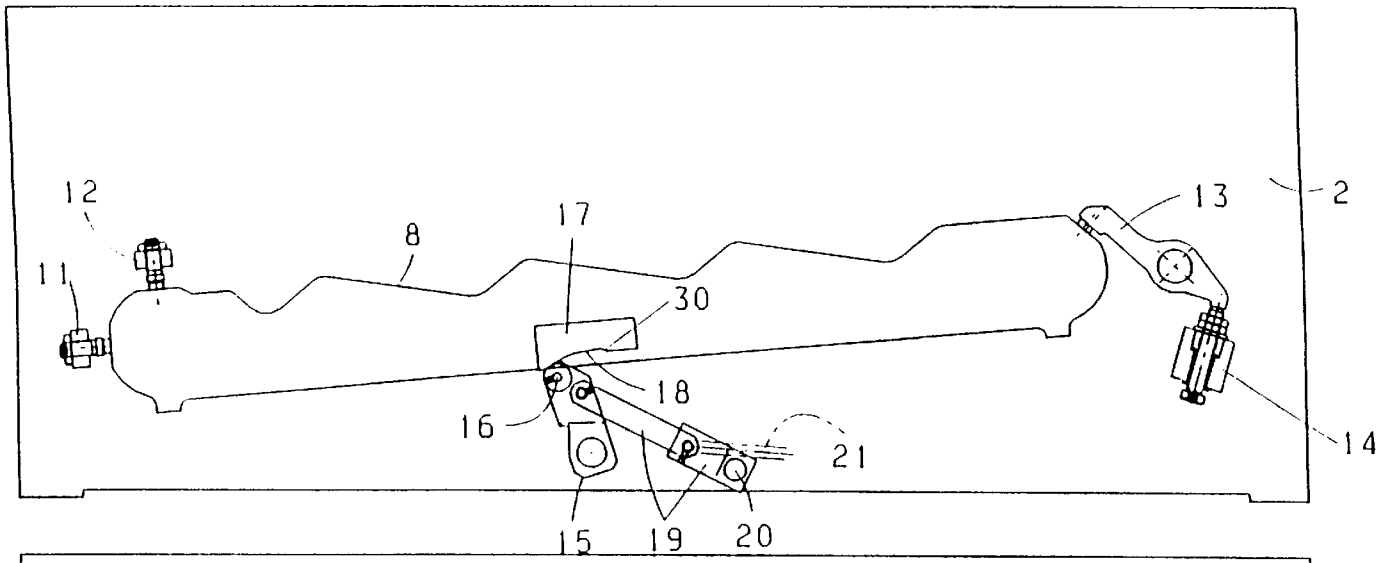
FIG. 2 shows the second side wall of the printing machine (not to be seen in FIG. 1) from the same viewing angle as well as a second side part of the belt-carrying unit.
Figure 3:
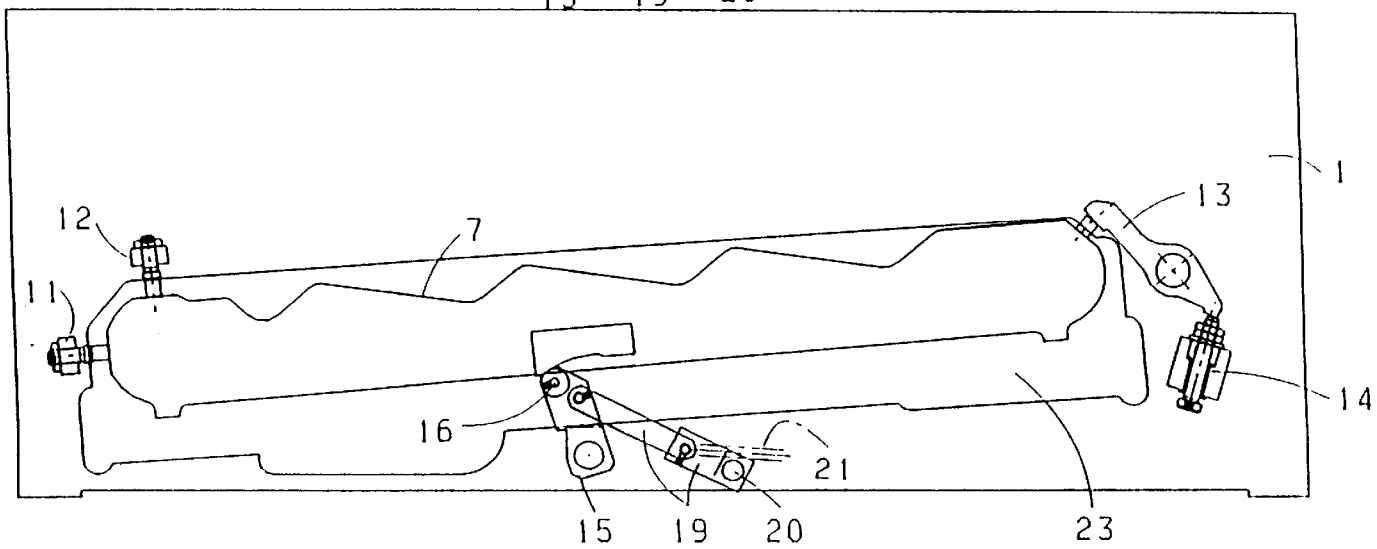
FIG. 3 shows a first side wall of the printing machine according to FIG. 1 together with a first side part of the belt-carrying unit.

The printing machine shown in FIGS. 1–3 comprises a machine frame with two side walls 1, 2, with the first side wall 1 being shown in FIG. 3, and with the second side wall 2 being shown in FIGS. 1 and 2.

Four printing units are disposed between the side walls 1, 2 so as to form a straight and almost horizontal line. FIG. 1 schematically shows four form cylinders 3, the axes of which extend perpendicular to the side walls 1, 2.

An endless transport belt 4 runs around two rollers 5, 6 which are spaced apart and disposed perpendicular to the side walls 1, 2 of the printing machine such that the upper side of the transport belt 4 contacts all four form cylinders 3.

Figure 4:
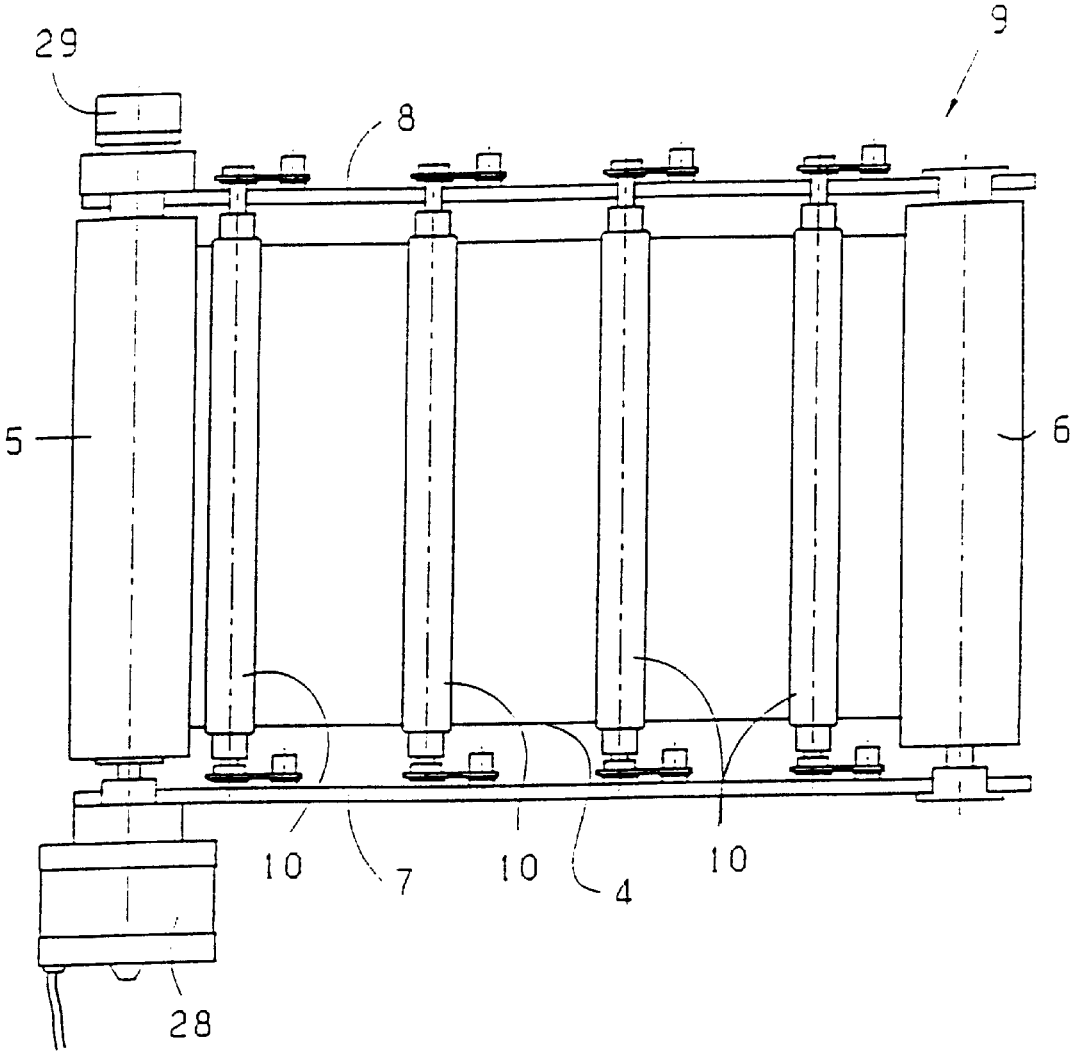
FIG. 4 is a view of the belt-carrying unit from above, with the upper side of the transport belt not being shown.
Figure 5:
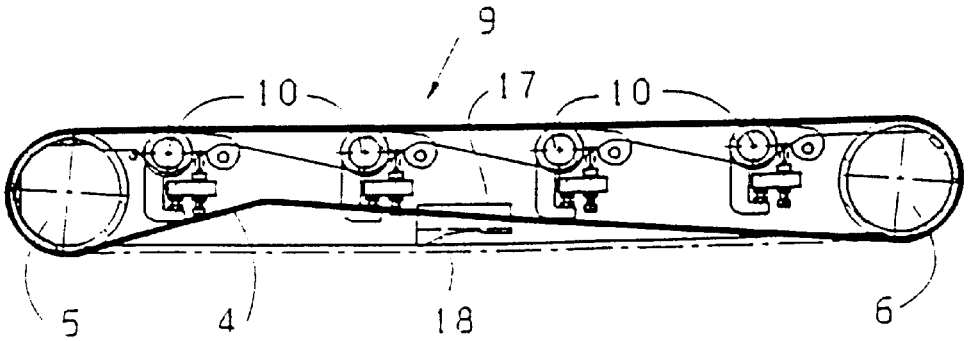
FIG. 5 is a sectional view of the belt-carrying unit taken in longitudinal direction.

The two rollers 5, 6 are not directly provided on the printing machine. Rather they are supported in side parts 7, 8 of a belt-carrying unit 9 (see FIG. 4) forming a unit which may be removed from the printing machine. The belt-carrying unit 9, represented in more detail in FIGS. 4 and 5, comprises the side parts 7, 8, with the rollers 5, 6, and four impression cylinders 10 pressing the transport belt 4 against the form cylinders 3 during operation of the printing machine. The impression cylinders are individually adjustable, as shown in FIG. 5.

The substrates or sheets to be printed are conveyed by means of a feeder (not illustrated) onto the transport belt 4 being driven via roller 5 or 6, and transported between form cylinders 3 and impression cylinders 10 due to the surface adhesion on the transport belt 4 and forces in the nips in order to be then deposited in a delivery bin (not illustrated).

A plurality of holding elements forming a holding device are provided on each side wall 1, 2 of the printing machine for holding the belt-carrying unit in the printing machine. These holding elements are disposed on the circumference of the side parts 7, 8 of the belt-carrying unit 9 when the belt-carrying unit is in the printing machine. As shown in FIGS. 1 through 3, the holding elements are designed as a left adjusting stop 11 and an upper adjusting stop 12, both located on the left end of side part 7, 8, a resilient stop 13 designed as a rotatable lever mounted on side wall 1, 2 and located at the right end of side part 7, 8 with one end of said lever acting on side part 7, 8, whereas an elastic force is applied to the other end by means of an adjustable compression spring 14, and a roller lever provided on the underside approximately in the center of side part 7, 8.

The roller lever comprises an arm 15, one end of which is pivot-mounted on side wall 1, 2 and the other end of which is mounted on a roller 16. A profile part 17 featuring a cam surface 18 facing towards the roller 16 is fastened to each side part 7, 8. In the operating positions of the belt-carrying unit 9 indicated in FIGS. 1 to 3, each arm 15 is in a position in which roller 16 presses against an elevated portion of the cam surface 18 and thus presses the respective side part 7, 8 against the adjusting stops 11, 12 and the resilient stop 13.

A toggle-lever linkage 19 fastened to one end of a shaft 20 through side wall 1, 2 and located in a respective extended dead-center position in FIGS. 1 to 3 is connected to each arm 15. Alternatively or additionally, such a stable position may be achieved by means of a tension spring 21 (schematically indicated) pulling the toggle-lever linkage against a stop 22 formed on the side wall 1, 2. The shaft 20 extends through the entire printing machine, with one end of shaft 20 being connected to a handle or the like on the outside of the printing machine.

Figure 6:
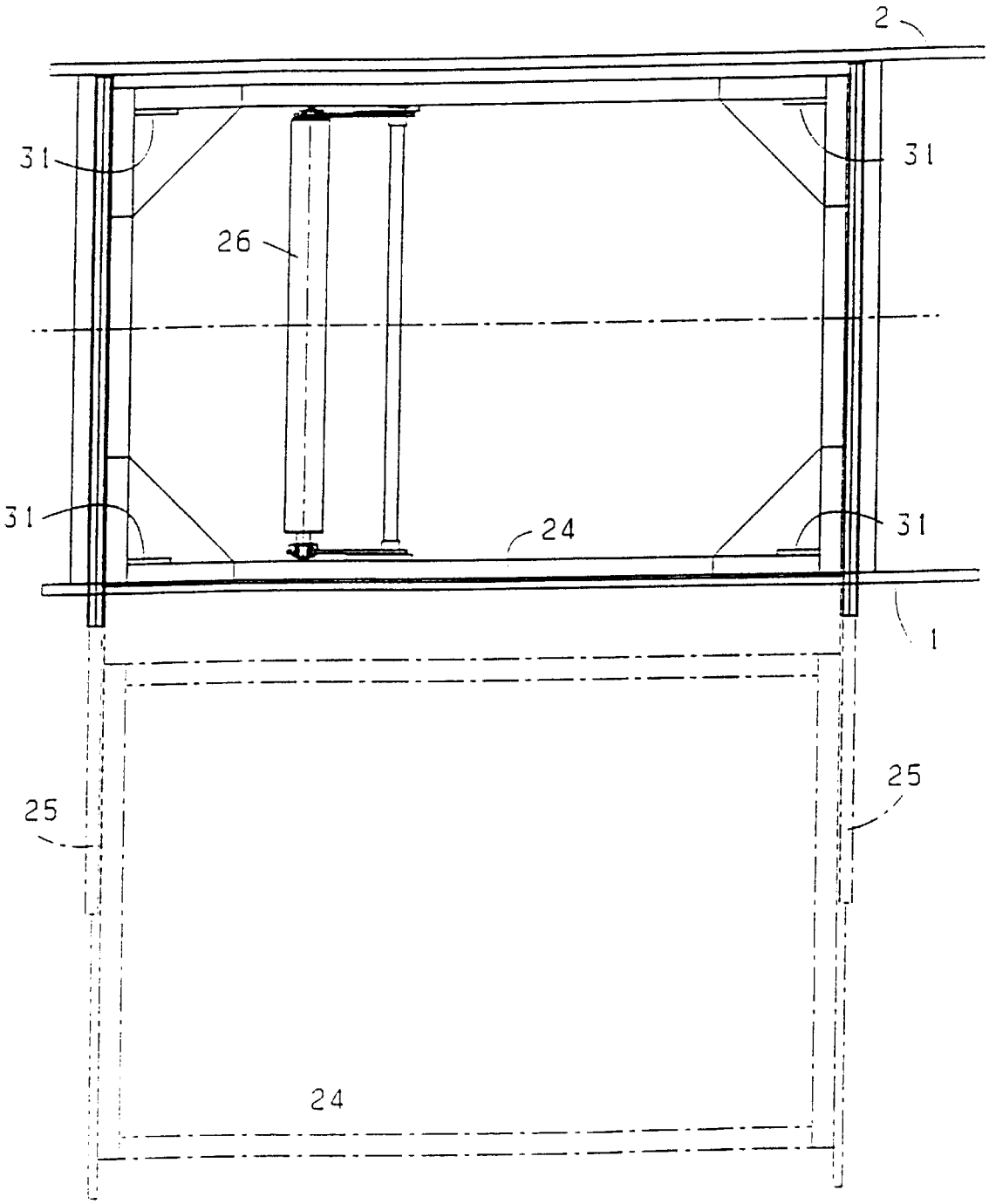
FIG. 6 is a view of a printing machine from above in the area of the drawer (the belt-carrying unit and the transport belt are not shown).

The side wall 1 features an elongated opening 23 (FIG. 3) which is larger than the belt-carrying unit 9. A rectangular and essentially flat drawer 24 (FIGS. 1 to 6) is located in a lower area of the opening 23 or below the belt-carrying unit 9 accommodated in the printing machine, said drawer being fastened to telescopic-type rails 25 which, in turn, are perpendicularly attached to the side walls 1, 2 of the printing machine. Through the opening 23 the drawer 24 may be pulled out of the printing machine by means of the telescopic-type rails 25 as indicated in FIG. 6 by a broken line.

A freely rotatable tensioning roller 26 extending perpendicularly to the side walls 1, 2 across the width of the transport belt 4 is pivot-mounted inside the drawer 24. The tensioning roller 26 is pre-tensioned upwards i.e. in direction of the transport belt 4 by means of compression springs 27 (FIG. 1).

If the transport belt 4 needs to be changed, the machine operator rotates the shaft 20 counterclockwise, thus causing the cam roller 16 to roll off on the cam surface 18 towards the right, with the belt-carrying unit 9 being lowered. The position of the cam surface 18 and the force of the elasticity of the resilient stop 13 being used to compensate for tolerances are selected such that, when actuating the switch, the belt-carrying unit 9 is first lowered only on the right-hand side, separating the impression cylinders 10, i.e. the transport belt 4, from the form cylinders 3.

This intermediate position of the belt-carrying unit 9 is maintained by means of a depression or a step 30 formed in the cam surface 18.

Since the position of the left roller 5 remains unchanged with the belt-carrying unit 9 in the intermediate position, the roller 5 may remain in meshing contact with drive elements and/or driven elements of the printing machine so that the machine may rotate in a pressureless manner, i.e. without any pressure being available between the form cylinders 3 and the transport belt 4, i.e. the impression cylinders 10. The embodiment of the belt-carrying unit 9 shown in FIG. 4 is equipped with an integrated drive motor 28 driving the roller 5. A gearwheel 29 may be fastened to the other end of the roller 5, with the belt-carrying unit 9 being respectively in an operating position and in an intermediate position, the gearwheel is in meshing contact with a printing-machine gearwheel in order to drive any further machine parts, If the belt-carrying unit 9 does not have its own drive motor 28, the printing machine may also drive the roller 5 via the gearwheel 29, or a further gearwheel connected to a drive motor of the printing machine is provided on the roller 5, with the belt-carrying unit 9 being in an intermediate position.

When rotating the switch or handle further, the belt-carrying unit 9 is lowered onto four prisms 31 disposed in the drawer 24. In this case, the elastic force of the tensioning roller 26 is overcome by the natural weight of the belt-carrying unit 9. In this position the gearwheel 29 provided on the shaft 5 is not in meshing contact with the printing machine. A relatively slight change in position of the shaft 5—for example, on the order of 1 mm—suffices to engage/disengage the gearwheel 29. The prisms 31 on which the journals of the shafts 5, 6 are mounted serve to fix the position of the belt-carrying unit 9 in the drawer 24, which is of particular importance when re-installing the belt-carrying unit 9.

Through the opening 23 formed in the side wall 1, the drawer 24, together with the belt-carrying unit 9 resting thereon, may now be pulled out of the printing machine. The belt-carrying unit 9 is removed from the drawer 24, and the transport belt 4 may be simply stripped off the rollers 5,6 by hand and replaced, as the tensioning roller 26 remains on the drawer 24. In reverse order the belt-carrying unit 9 may be re-installed.

What is claimed is:

1. A printing machine comprising:

a plurality of printing units arranged in line one behind the other;

an endless transport belt for transporting substrates through the plurality of printing units;

a belt-carrying unit from which the belt may be removed when in a slack condition;

at least two rollers mounted on the belt carrying unit, the transport belt being supported by the at least two rollers;

a drawer moveable with respect to a side of the printing machine, the drawer located below the belt-carrying unit; and a holding device connected to the printing machine for holding the belt-carrying unit in at least two different conditions, including a first condition in which the holding device holds the belt-carrying unit in an operating position and a second condition in which the belt-carrying unit rests loosely on the drawer.

2. The printing machine as recited in claim 1 further comprising a side wall having an opening, the opening being large enough to permit the drawer, together with the belt-carrying unit, to be pulled through the side wall.

3. The printing machine as recited in claim 1 further comprising a resiliently pre-tensioned tensioning roller on the drawer for tensioning the transport belt.

4. The printing machine as recited in claim 1 wherein the holding device comprises a plurality of stops and at least one quick-action tensioning device, the quick-action tensioning device being switchable so that in the first condition said quick-action tensioning device presses the belt-carrying unit against the stops, and in the second condition the belt-carrying unit is released.

5. The printing machine as recited in claim 4 wherein each quick-action tensioning device comprises an arm and a cam roller, the arm having an end rotatably mounted on the printing machine and the cam roller being rotatably mounted on another end of the arm, the cam roller interacting with a cam surface on the belt-carrying unit during rotation of the arm.

6. The printing machine as recited in claim 4 wherein there are at least two quick-action tensioning devices.

7. The printing machine as recited in claim 4 wherein between the first condition and the second condition the holding device has at least one additional switching condition in which the belt-carrying unit is not in an operating position but is held, at least partially, on the printing machine.

8. The printing machine as recited in claim 5 wherein between the first condition and the second condition the holding device has at least one additional switching condition in which the belt-carrying unit is not in an operating position but is held, at least partially, on the printing machine.

9. The printing machine as recited in claim 8 wherein the at least one additional switching condition of the holding device is maintained by a step in the cam surface.

10. The printing machine as recited in claim 5 wherein the cam surface has a step.

11. The printing machine as recited in claim 1 wherein between the first condition and the second condition the holding device has at least one additional switching condition in which the belt-carrying unit is not in an operating position but is held, at least partially, on the printing machine.

* * * * *